US009945111B1

(12) United States Patent
Nuncio

(10) Patent No.: US 9,945,111 B1
(45) Date of Patent: Apr. 17, 2018

(54) TOILET WITH EASY ACCESS CLEANOUT

(71) Applicant: Theodore Nuncio, Denver, CO (US)

(72) Inventor: Theodore Nuncio, Denver, CO (US)

(73) Assignee: CHALLENGE LLC, Centennial, CO (US)

( * ) Notice: Subject to any disclaimer, the term of this patent is extended or adjusted under 35 U.S.C. 154(b) by 8 days.

(21) Appl. No.: 15/068,359

(22) Filed: Mar. 11, 2016

(51) Int. Cl.

| | |
|---|---|
| ***E03D 9/00*** | (2006.01) |
| ***E03D 9/06*** | (2006.01) |
| ***E03D 11/13*** | (2006.01) |
| *E03C 1/30* | (2006.01) |

(52) U.S. Cl.
CPC ..... *E03D 9/06* (2013.01); *E03D 11/13* (2013.01); *E03C 1/30* (2013.01)

(58) Field of Classification Search
USPC ..... 4/256.1
See application file for complete search history.

(56) References Cited

U.S. PATENT DOCUMENTS

| | | | | |
|---|---|---|---|---|
| 763,561 A * | 6/1904 | Hooper | ..... | E03D 11/10 4/256.1 |
| 1,070,003 A * | 8/1913 | Beswick | ..... | E03D 11/00 137/251.1 |
| 1,827,663 A * | 10/1931 | Mastrillo | ..... | E03D 11/13 138/92 |

* cited by examiner

*Primary Examiner* — Lauren Crane
(74) *Attorney, Agent, or Firm* — Ramon L. Pizarro; Edwin H. Crabtree

(57) ABSTRACT

A toilet that with a cleanout aperture and an access panel or plug that provide access to highest point the siphon section of the toilet. The access panel extends over aperture that extends from the flush water inlet surface to the crest, or apex, of the siphon section. The cover plate extends over the flush valve support surface provides access to the siphon section to provide access to clogs in the up sloping, apex, or down sloping portions of the siphon section. The toilet may be wall-mounted or floor mounted.

1 Claim, 1 Drawing Sheet

TOILET WITH EASY ACCESS CLEANOUT

BACKGROUND OF THE INVENTION

(a) Field of the Invention

This application relates to a system for facilitating the cleanout of clogged toilets. More particularly, but without way of limitation, to a toilet and cleanout access panel that allows easy removal of clogging material, without introducing restrictions to flow from the toilet.

(b) Discussion of Known Art

There have been a number of approaches at providing a flushable toilet with access to the siphon passage of a toilet. One example of these devices is found in U.S. Pat. No. 6,212,696 to Ray. Another approach is disclosed in U.S. Pat. No. 918,036 to Gibson. Both Ray and Gibson use round expandable plugs to seal an access opening in the siphon passage. While these devices do provide access to clogs within the siphon passage of the toilet, they do have limitations. For example, these devices provide access through a side opening along the siphon passage. The use of a side opening results in limited access and visibility to locations that are at a distance from the side opening.

U.S. Pat. No. 563,397 to Morrison shows the use of a removable cover over a "hand-hole" that is provided for providing access to the interior of the discharge pipe. The removable cover of the Morrison device incorporates a pronounced concave portion for the siphon section. This arrangement requires a large sealing area that is positioned along a sharp bend. Thus, while the hand-hole approach disclosed by Morrison would provide access to the siphon area for removing materials that have become lodged in the siphon area, the approach has significant limitations in that the cover must be removed from behind the bowl. The cover would inevitably be positioned between the bowl of the toilet and a wall. This presents problems with access, visibility into the siphon area, and is vulnerable to improper re-assembly due to the cramped position of the cover. Accordingly, while Morrison recognized the need to provide an access cover to the siphon section of the toilet, the approach disclosed by Morrison hampered the usefulness of the access panel and hand-hole.

Another known approach is shown in U.S. Pat. No. 568,222 to Schifflin, which shows the use of a bolted panel. The Schifflin devices do not solve the problems of access, in that the panels are positioned at locations on the siphon or flow path.

Therefore, a review of known devices reveals that there remains a need for a simple system for cleaning out clogs from toilets is a quick and reliable manner, and which requires few, if any specialized tools.

SUMMARY

It has been discovered that the problems left unanswered by known art can be solved by providing a floor mounted or wall mounted toilet bowl having:

A bowl with a rim is provided with a system for facilitating the removal of clogs in the siphon section of the toilet. As is commonly found in toilets, the bowl has an outlet for delivering contents found within the bowl to a siphon section that is used to evacuate the bowl. The water used to cleanout or flush the bowl is delivered from either a tank or a water line, and released into the bowl through a flush valve that is connected to a flush aperture that accepts water to be used for flushing the contents of the bowl. The disclosed invention provides a surface that includes a cleanout aperture that extends into the siphon section of the toilet. It is contemplated that the cleanout aperture will provide access to the highest point, or apex, in the siphon section, and thus according to a disclosed example of the invention the cleanout aperture is positioned directly over the highest point of the siphon section, so as to provide access to the up-sloping portion of the siphon section and to the down-sloping portion of the siphon section. Additionally, a cover plate adapted for mounting over the cleanout aperture, along a surface between the rim and the flush water supply inlet on the toilet, is used to provide easy access at a location that is unlikely to be under any water pressure when the cover plate is removed.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
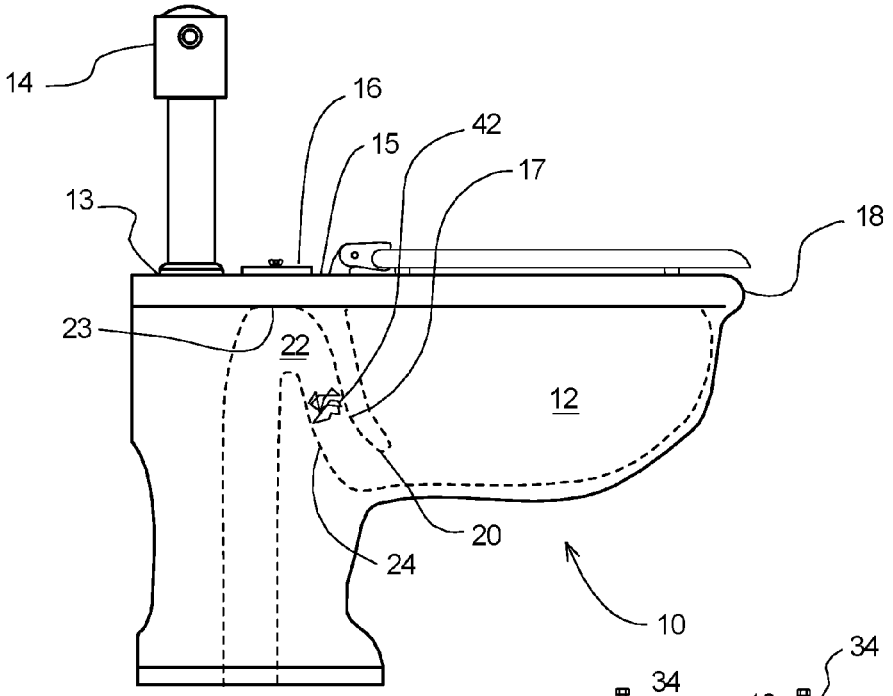
FIG. 1 is a side view of an embodiment of the invention, the view showing the toilet with a simplified view of the siphon section shown in dashed lines.

Turning now to FIG. 1 where a side view of an embodiment of a toilet 10 including inventive features disclosed here has been shown. It is contemplated that water to the toilet will be delivered through a commercial style flush valve 12, such as a diaphragm type valve or from a tank as is commonly done in residential applications. An example of a commercial style flush valve commonly used in commercial applications is shown in U.S. Pat. No. 5,213,305 to Wilson, or valves such as the Sloan Regal flushometer type valve manufactured by the Sloan Company of 10500 Seymour Avenue Franklin Park, Ill. 60131. These types of valves typically mount to the rear of bowl to deliver the water to the toilet 10 through a flush aperture 13, and do away with the need for a water tank or reservoir that is mounted behind the bowl. It is also contemplated that the disclosed invention may be used with a conventional tank-style toilet that provides sufficient space for the cover 16 over the siphon section 22, as discussed below.

Figure 2:
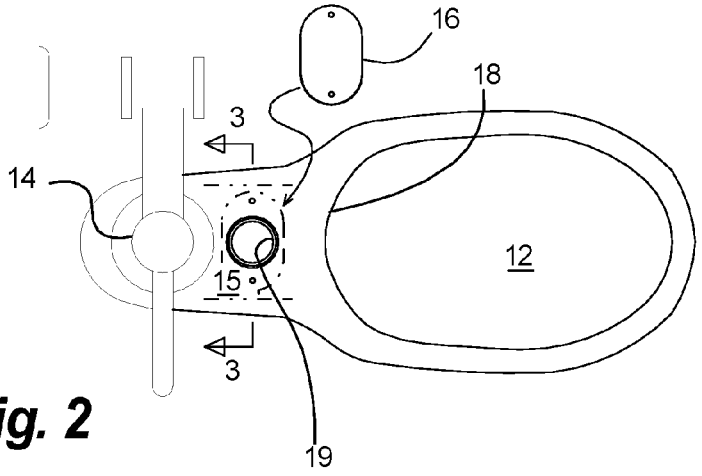
FIG. 2 is a view looking down at the example shown in FIG. 1, and illustrating the position of cover plate and example of cleanout access hole.

Turning now to FIGS. 1 and 2, it will be understood that the disclose toilet 10 has been adapted for cooperating with a commercial style flush valve 14 or a reservoir tank, as are found in most residential applications. The tank or commercial style valve, deliver the water to be used for clearing out the contents of the bowl 12 of the toilet 10. The flush valve 14 is mounted from a flush water inlet support surface 15 that incorporates the flush aperture 13 that accepts the water from the flush valve or from the tank that is used to hold water that is used to flush. The flush water inlet support surface 15 extends back from a location near the rim 18 of the bowl 12. Between the rim 18 and the mounting location for the flush valve 14 is a cleanout aperture 19, which extends from the valve support surface 15 and into a siphon section 22. The siphon section 22 extends from the bowl 12 and up towards the cleanout aperture 19. After reaching the siphon section 22, the slope of the siphon section 22 reverses and progresses down. Accordingly, in a preferred example of the disclosed invention the aperture 19 is positioned at or near the crest 23 of the siphon section 22, so that clogs in either the upwardly sloping section 24 of the siphon section 22, or in the downwardly sloping (or vertical) section 25 may be readily accessed from the cleanout aperture 19.

Figure 3:
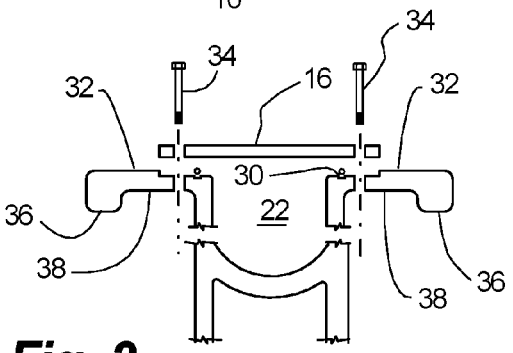
FIG. 3 is a view taken along line 3-3 on FIG. 2, looking in the direction indicated by the arrows extending from line 3-3.

Accompanying FIGS. 1-3 also show that access to the siphon section 22 is provided by cover plate 16 that extends over the cleanout aperture 19. Thus, removal of the cover plate 16 from the flush water inlet support surface 15 provides access to a clogged section 17, which may have formed in the siphon section 22 of the toilet 10.

Focusing now on FIG. 3, which is a section view taken from FIG. 2, shows that it is contemplated that the cover plate 16 will be held over the cleanout aperture 19 and over the flush water inlet support surface 15 by way of at least one fastener 34. It is contemplated that a single fastener 34 may be used by providing an overhang that traps one section of the cover plate 16, in a manner as disclosed in U.S. Pat. No. 1,684,983 to Clark, incorporated herein in its entirety by reference. However, it is contemplated that two or more fasteners may also be used.

Accordingly, in an illustrated example, a pair of fasteners 34 are used to retain the cover plate 6. The fasteners 34 extend through apertures in the cover plate 16 and through matching apertures in the flanges 32. This arrangement is part of the example illustrated in FIGS. 2 and 3. Still further, as shown in FIG. 3, it is contemplated that each of the flanges 32 will terminate in a lip 36 that extends down from each flange 32. The lip 36 of each flange 32 will define a valley 38. The fasteners 34 will extend from the plate and to a location on or near the lip 36.

Accordingly, the bowl 12 has an outlet 20 that allows the any contents found within the bowl 12 to be urged into the siphon section 22. The siphon section 22 will create siphoning action that will draw any contents found within the bowl to be drawn from the bowl 12 and be delivered into the sewer lines that serve the building.

As discussed above, the disclosed system will facilitate removal of a clog 40 in the clogged section 17 of the siphon section 22. To locate and remove the clog 40, a user would simply remove loosen the fasteners 34 and remove the cover plate 16 to expose the clog 40 below the cleanout aperture 19. It should be noted that the position of the cover plate 16 and cleanout aperture 19 along the flush water inlet support surface 14 provides advantages over known devices that provide cleanout access along siphon section 22, but provide this access at a location that is not the highest point along the siphon section 22. Not only does the disclosed system provide improved visibility to the internal passage of the siphon section 22, but it also prevents spillage of water trapped behind the cover plate 16, within the siphon section 22, upon loosening of the cover plate 16.

Once the cover plate 16 is removed, the user can either extract the clog 40 through the cleanout aperture 19, or push the clog back towards the bowl 12 or down into the downwardly sloping section 25 of the siphon section 22. Pushing the clog 40 further down into the downwardly sloping section 25 of the siphon section 22 allows the use of water in the system to urge the clog further down, towards the main sewer lines. Accordingly, in certain situations the disclosed system will greatly facilitate users to move the clog towards the main sewer lines, where the clog will encounter less resistance to flow, and thus facilitate elimination of the clog without having to remove any of the materials from the system itself. Eliminating the need to remove clog materials also eliminates the risk of spilling sewage material on the area around the toilet, and thus obviating the risk creating additional problems associated with the cleanup of spilled sewage.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A toilet that is adapted for cooperating with a commercial style, tankless, flush valve, the toilet allowing access to a clogged section of the toilet, the toilet replacing commercial style toilet installations to provide access to the clogged section of the toilet, the toilet comprising:

a bowl with a rim, the bowl having an outlet for delivering contents found within the bowl to a siphon section that is used to evacuate the bowl;

a flush water inlet support surface extending from the bowl, the flush water inlet support surface having a flush aperture accepting water delivered to the bowl from the commercial style flush valve for flushing the contents from the bowl, the flush water inlet support surface further comprising a cleanout aperture that extends into the siphon section from the flush water inlet support surface, the cleanout aperture having a perimeter along the support surface and being positioned between the flush aperture and the bowl, the inlet support surface further having a pair of flanges that extend away from the siphon section and along with the water inlet support surface, such that the siphon section is positioned between the pair of flanges;

a cover plate that extends over the pair of flanges and cleanout aperture and is secured from the pair of flanges and directly against the perimeter of the cleanout aperture, each of said flanges terminates in a lip that extends down from each flange, the lip and the flange defining a valley near the siphon section, and, each flange having at least one fastener aperture that accepts one of the fasteners, so that each of the fasteners extends through the respective flange and protrudes into the respective valley under the respective flange, so that access to the siphon section and sealing access to the cleanout aperture, and the clogged section of the toilet siphon section is readily accessible by removing the cover plate from the water inlet support surface.

* * * * *